United States Patent [19]

Sparrow

[11] 4,156,989

[45] Jun. 5, 1979

[54] DOOR STRUCTURE AND MECHANISM FOR SEALING THE GAP BETWEEN THE CLOSURE MEMBER AND FRAMEWORK

[76] Inventor: Leslie F. Sparrow, 16, Mersey St., Christchurch, 1, New Zealand

[21] Appl. No.: 765,428

[22] Filed: Feb. 3, 1977

[30] Foreign Application Priority Data

| | | | |
|---|---|---|---|
| Feb. 10, 1976 | [NZ] | New Zealand | 179967 |
| Jul. 22, 1976 | [NZ] | New Zealand | 181537 |
| Aug. 9, 1976 | [NZ] | New Zealand | 181716 |
| Oct. 20, 1976 | [NZ] | New Zealand | 182383 |

[51] Int. Cl.[2] ..... E06B 7/16; E06B 7/20

[52] U.S. Cl. ..... 49/481; 49/304; 49/477

[58] Field of Search ..... 49/304, 306, 307, 477, 49/480, 481, 482, 469; 160/40

[56] References Cited

U.S. PATENT DOCUMENTS

| | | | |
|---|---|---|---|
| 1,485,208 | 2/1924 | Altman et al. | 49/304 |
| 3,449,864 | 6/1969 | Prost-Dame et al. | 49/477 |

FOREIGN PATENT DOCUMENTS

| | | | |
|---|---|---|---|
| 2302105 | 8/1973 | Fed. Rep. of Germany | 49/304 |

*Primary Examiner*—Philip C. Kannan

*Attorney, Agent, or Firm*—Cushman, Darby & Cushman

[57] ABSTRACT

A door comprising a supporting framework, a closure member supported by the framework and a mechanism for sealing the door at least at the bottom thereof and including a base member lying below the closure member in its closed position and apparatus for lifting the base member to close any gap between it and the closure member.

3 Claims, 5 Drawing Figures

DOOR STRUCTURE AND MECHANISM FOR SEALING THE GAP BETWEEN THE CLOSURE MEMBER AND FRAMEWORK

BACKGROUND OF THE INVENTION

The present invention relates to doors and in particular to apparatus for sealing doors to reduce the accoustic transmission thereof.

Throughout this specification, the term 'door' is used to denote the structure inserted in an aperture in a wall to enable that aperture selectively to be opened or closed and includes, though not exclusively, windows, room dividers and moving walls in addition to room access doors.

It is a feature of all doors, that if they are to be relatively easy to open and close they must be clear of the top and bottom of their frame at least when they are moving. This applies equally to sliding, swinging and revolving doors. While the provision of a small gap at the bottom of the door makes for ease of operation it prevents the door acting as an efficient accoustic or gas-tight barrier. In some cases this can be overcome by providing a flange against which the door seats in the closed position. This is not suitable in most cases where the door extends to floor level since it would involve a stepped uneveness permanently present on the floor. It has also been proposed to mount a brush-like or spring-loaded member on the base of the closure member to prevent draughts. These devices must, however, be a compromise since they cannot provide such a powerful seal that the opening and closing of the door becomes difficult.

It is an object of the invention to provide a door which can be sealed positively to reduce the accoustic transmission thereof.

SUMMARY OF THE INVENTION

The invention provides a door which comprises a supporting framework defining three sides of an aperture, a closure member supported by the supporting framework and movable between an open position and a closed position, a base member defining a fourth side of the aperture and lifting means for moving the base member from a lowered position to a raised position whereby any gap between the base member and the closure member when in its closed position, is closed.

By providing a positively sealing mechanism which is operated only when the door is in the closed position, good sound-proofing can be obtained without interfering with the operating clearances of the door. Operating clearances at the top of the door can be dealt with, if the closure member is allowed some vertical movement in the framework, and the lifting means is arranged when the door is closed, to urge the closure member upwards to close any gap at the top thereof. Normally an adequate seal will be obtained at the sides of the door by static sealing means, but to provide a positive gastight seal, there may be provided a like mechanism at the sides of the door. Further, only a small sealing force on the door will exert such a drag that the door will be effectively locked in position.

In a preferred embodiment, the lifting of the base member to seal the door is achieved by the use of a pneumatically inflatable member which is simple and reliable in operation. Further, because a pneumatically inflatable member can occupy a small volume when deflated, a door constructed in accordance with the invention can be installed in an existing building without major structural alterations.

The invention will now be described in more detail by way of example with reference to the accompanying drawings.

BRIEF DESCRIPTION OF THE DRAWINGS

Referring to FIGS. 1 and 2 of the accompanying drawings, the door shown comprises a sliding, folding room divider, which is formed from a plurality of uprights 1 to each of which, other than the endmost, are hinged four panels 2. Mounted at the upper end of each upright 1 is a plate 3 which carries a spindle 4, the wheels of the spindle running in a support track 5. The track is fitted in a member 6 and is adjustably mounted to a supporting lintel 7. Also mounted on the member 6 may be a pelmet 8 within which can be packed accoustically absorbent material.

Figure 1:
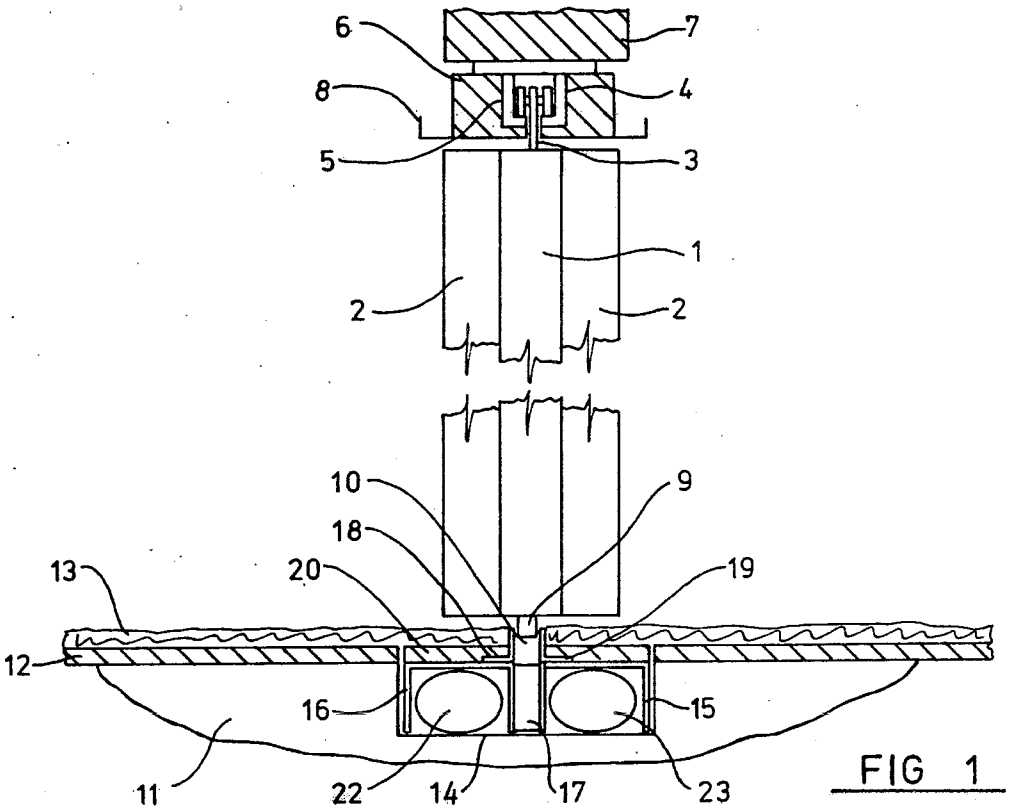
FIG. 1 shows part of a first door in vertical end section.

At the lower end of each upright 1 is a fillet 9 which is arranged to run in a guide track 10 to prevent twisting or other undersired movement of the door.

The floor in the present example comprises a concrete layer 11 on which is layed an underlay 12 and a carpet 13. Mounted in the channel 14 are two inverted metal channels 15 and 16 which are separated and connected by a wooden fillet 17. The outer sides of the channels 15 and 16 are parallel to and closely spaced from the vertical walls of the channel 14 so that they form a baffle to reduce sound transmission around the base member. Mounted on the channel 16 is an angle iron 18 and mounted on the channel 15 is an angle iron 19, the irons 18 and 19 cooperating to form the guide track 10. Also mounted on the channels 15 and 16 are pieces of particle board 20, for example, which are rebated over the horizontal portions of the angles 18 and 19 and are covered with carpet 13.

Mounted within the channel 16 is a collapsible relatively heavy duty rubber tube 22 and mounted within the channel 15 is a similar tube 23, and there is provided means for supplying air to the tubes. The air supply means includes a compressor (not shown) and a control valve and switch 24 is shown schematically in FIGS. The control 24 includes an operating switch 25 by means of which the compressor may be started and the inlet valves to the tubes 22 and 23 opened and exhaust valves closed. A further switch 26 is provided in the door stile so that the switch 25 is disabled when the door is not fully closed. The control 24 is arranged to switch off the compressor when the operating pressure is reached, but there are provided two micro-switches 27, one on either side of the door track 5, which prevent the compressor being switched off until both the switches 27 are closed. The forces across the door are thus balanced. Several further micro-switches 27 may be provided along the length of the track 5 to ensure that forces are balanced along the door as well as across it.

The operation of the door is as follows:

In normal use the door hangs by the plates 3 from the spindles 4 in the track 5 and can be slid along the track. When it is desired accoustically to separate the areas on either side of the door it is moved to the closed position, the double sides nature of the door providing some degree of insulation.

By closing the door the switch 26 is operated so that when the switch 25 is closed, the compressor starts and air is pumped into the tubes 22 and 23 which inflate. As the pressure in the tubes 22 and 23 increases an upward force is exerted on the channels 15 and 16 raising them to close the gap at the bottom of the door and urging the top of the door against the pelmet 8 to seal the upper gap. When the top of the door meets the pelmet 8 the micro switches 27 are closed either together, if the forces on the door are balanced, or one after the other if they are not. Once both the switches 27 are closed, the inlet and exhaust valves are closed and the compressor switched off so that the door is held in the sealed state.

Figure 3:
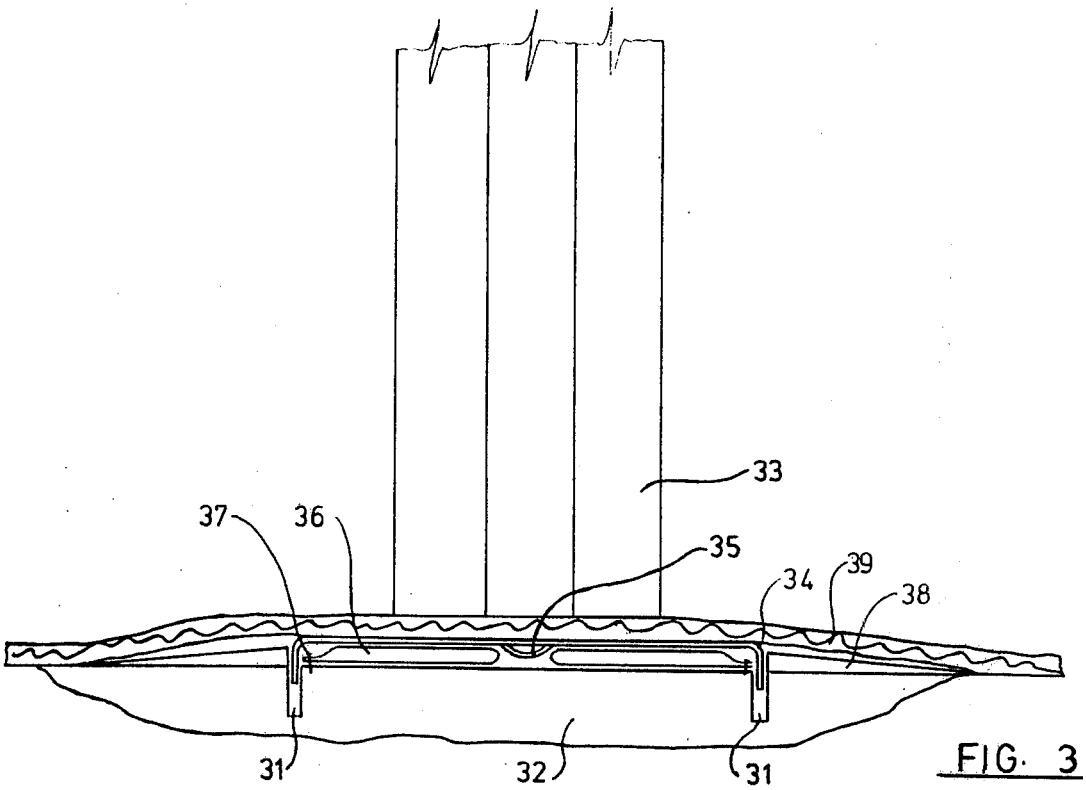
FIG. 3 is a view similar to FIG. 1 of part of a modified form of door.

Referring to FIG. 3 of the accompanying drawings, the door closure itself may be generally similar to that described above, only the lifting mechanism and its method of installation being modified. As shown, no guide track 10 is provided on the base and accordingly the fillet 9 is also omitted. This modification may be made in most applications, since when the door is raised the forces acting on it typically 750 Kg force, are generally sufficient to prevent any lateral movement.

Where a door constructed in accordance with the invention is to be installed in an existing building a large channel may not be possible to construct, or might seriously weaken the floor. To avoid this, two parallel saw cuts 31 are formed in a concrete floor 32 to a depth that is not a substantial fraction of the floor's thickness. The cuts 31 are so positioned that a door 33 in its closed position lies between them and a substantial distance from each of them, as shown. An inverted metal channel 34 which may have a reinforcing rib 35 is mounted in the cuts 31 which in turn locate the channel and prevent it wandering to either side. The fit of the walls of the channel 34 in the cuts 31 is such that, while the channel moves freely the gap is small enough to act as a baffle to reduce accoustic transmission. Beneath the channel 34 are mounted two inflatable tubes 36 each of which is fixed to the floor 32 along its outermost edge 37.

The channel 34 in its lowered position stands only slightly proud of the concrete floor 32 and this slight unevenness is masked by providing a wedge shaped underlay 38 leading up to the channel 34. Thus the carpet or other floor covering 39 can be carried in a continuous sweep over the channel 34 without there being any major obstruction or hazardous step.

Figure 2:
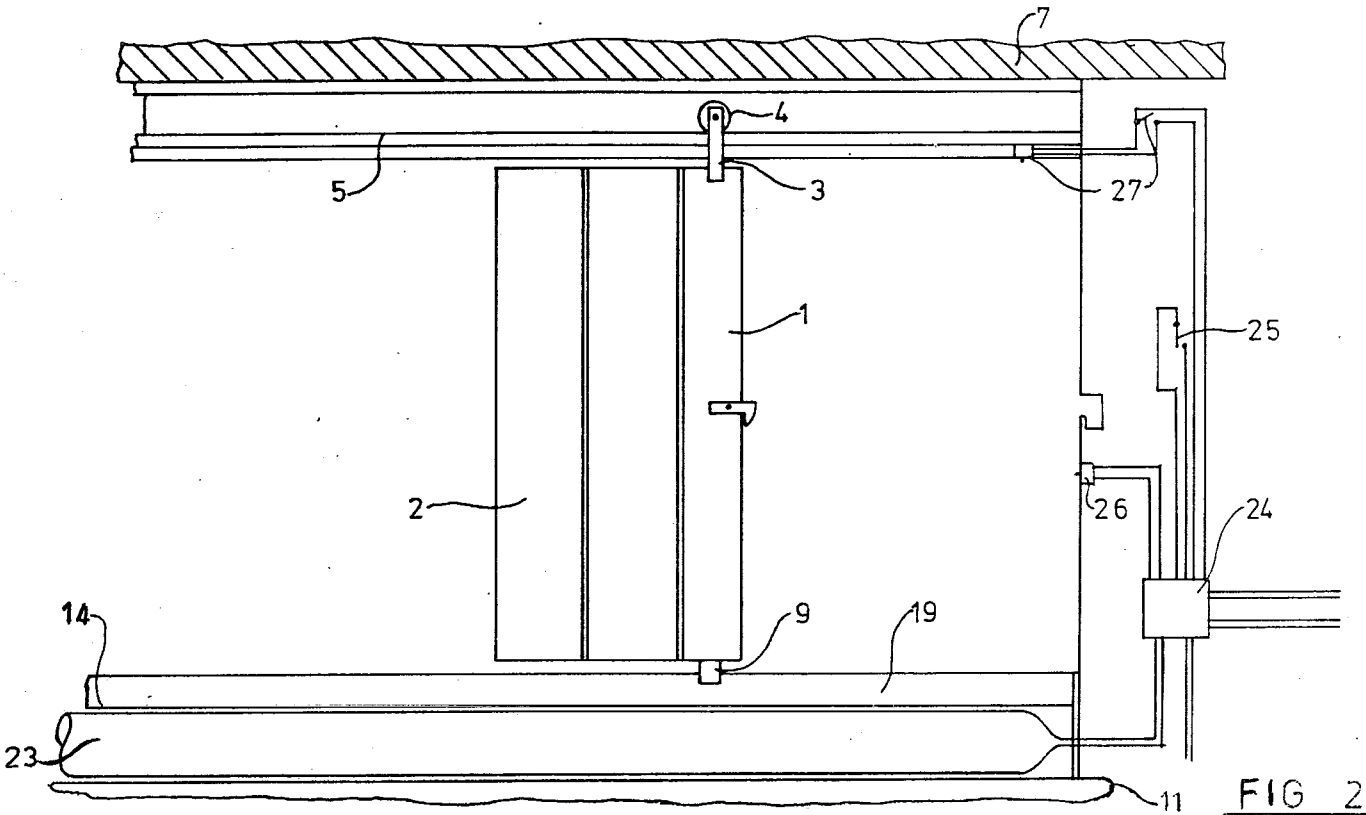
FIG. 2 shows part of the door of FIG. 1 in vertical side section.

The method of operation of this form of door is as described above with reference to FIGS. 1 and 2 except that, because the tubes 36 are fixed at one side, as they are inflated their free sides will tend to move apart applying a greater force at the sides of the door 33 where the sealing is required.

Figure 4:
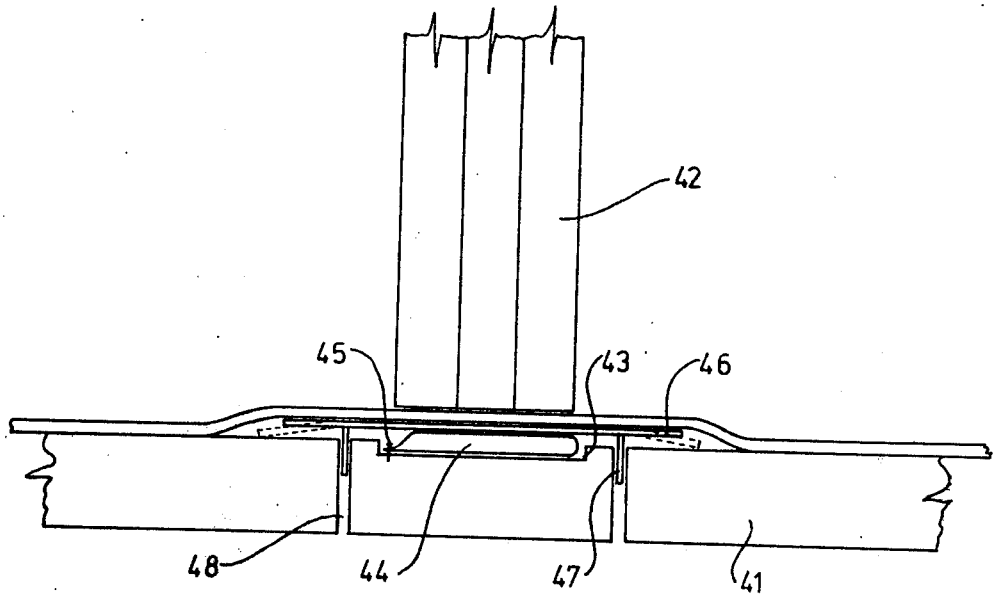
FIG. 4 is a view similar to FIG. 1 of part of a further modified form of door.

Referring now to FIG. 4, there is shown a simplified version of the door shown in FIG. 3, which may easily be installed in existing buildings, or in any building having relatively thin floors without weakening them substantially. As shown, the floor 41 has been built to accommodate the door 42 and includes a shallow channel 43. The channel 43 may include a small lesser depth extension to accept the edges of a plate 46 when in its lowered position so that the plate is completely flush with the floor. The channel may be formed in a concrete floor by mounting a strip of, for example, wood at floor level when the concrete is being poured and removing it as the concrete sets.

Mounted in the channel 43 is an inflatable rubber tube 44 which is held down at one edge 45 and which, when deflated has its upper surface level with or below the general level of the surface of the floor 41. Lying over the tube 44 is a plate 46 which is located by a plurality of depending studs 47 cooperating with holes 48 in the floor 41. To position the holes 48 accurately the plate 46 may be used as a template the holes 48 being drilled through the stud holes, but a simpler and more accurate method is to use studs 47 which are provided with a central hole through which a pilot hole may be drilled, ensuring accurate drilling of the final hole 48. In a custom built installation, the air supply and return lines for the tube 44 may be cast into the floor 41 or may be carried through to the ceiling space below the floor.

If even a shallow channel 43 cannot be formed in the floor 41, the tube 44 is mounted directly on the floor and the edge portions of the plate 46 are, as shown in broken lines, turned downwards to provide a ramp up to the portion of the plate which engages the base of the door. The actual operation of either system is substantially as described above with reference to FIG. 3, except that, since there is no inverted channel member there is no baffle effect. Accordingly, to achieve a high accoustic attenuation, a heavy gauge of material must be used in the construction of the tube 44.

Figure 5:
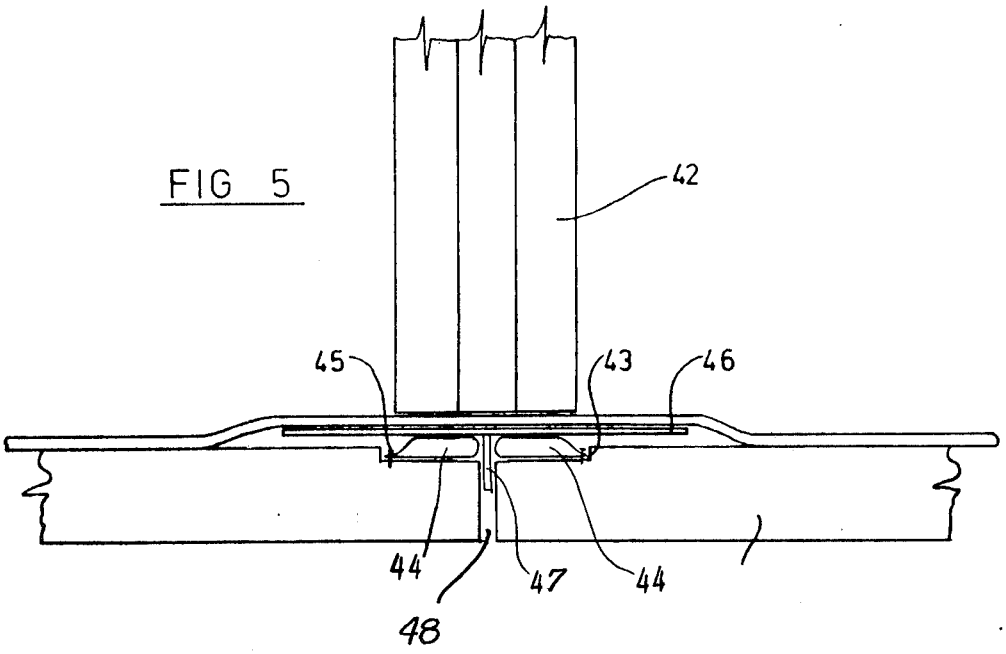
FIG. 5 is a view similar to FIG. 1 of a fourth form of door.

A still simpler installation is possible if as shown in FIG. 5 only a single row of studs 47 is mounted along the centre line of the plate 46 and two tubes 44 are provided, one on each side of the row of studs. In this case, therefore, only a single row of holes 48 must be drilled thus halving this aspect of the installation time and reducing the weakening of the floor.

While pneumatic lifting systems for the base member are considered most suitable by the applicant, it is envisaged that in certain circumstances, a mechanical or hydraulic system would be feasible. In those cases the inflatable tube or tubes could be replaced by a plurality of cams or eccentrics or by a hydraulic jacking system.

I claim:

1. A door which comprises a supporting framework defining three sides of an aperture, a closure member supported by the supporting framework and movable above a floor between an open position and a closed position, an inverted channel member defining a fourth side of the said aperture, said inverted channel member having depending sides arranged to lie in slots provided in the floor, and lifting means including a pneumatically inflatable tube lying within said inverted channel member and lying on the floor for moving said inverted channel member from a lowered position to a raised position whereby any gap between said inverted channel member and said closure member when in said closed position, is closed.

2. A door as in claim 1 including ramping to raise the level of the floor smoothly to the level of said inverted channel member.

3. A door as in claim 1 wherein said framework is arranged to allow movement of said closure in a vertical plane and wherein said inflatable tube is arranged when said closure member is in said closed position to lift said closure member to close any gap at the top thereof.

* * * * *